US009535357B2

(12) United States Patent
Okubo

(10) Patent No.: US 9,535,357 B2
(45) Date of Patent: Jan. 3, 2017

(54) IMAGE FORMING APPARATUS HAVING A VOLTAGE APPLICATION UNIT FOR APPLYING A VOLTAGE TO A DEVELOPING ROLLER AND A CHARGER

(71) Applicant: KYOCERA Document Solutions Inc., Osaka (JP)

(72) Inventor: Takahiro Okubo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/133,964

(22) Filed: Apr. 20, 2016

(65) Prior Publication Data

US 2016/0334732 A1 Nov. 17, 2016

(30) Foreign Application Priority Data

May 11, 2015 (JP) ..... 2015-096274

(51) Int. Cl.
*G03G 15/02* (2006.01)

(52) U.S. Cl.
CPC ..... *G03G 15/0283* (2013.01); *G03G 15/0216* (2013.01); *G03G 15/0266* (2013.01)

(58) Field of Classification Search
CPC ..... G03G 15/065; G03G 15/0266; G03G 15/0283; G03G 15/0216; G03G 2215/021
USPC ..... 399/50, 176
See application file for complete search history.

(56) References Cited

U.S. PATENT DOCUMENTS 6,801,724 B2 * 10/2004 Matsumoto ..... G03G 15/086 399/38
2006/0104681 A1 * 5/2006 Hanashi ..... G03G 21/0029 399/351
2006/0251432 A1 * 11/2006 Shibata ..... G03G 15/0266 399/44

FOREIGN PATENT DOCUMENTS

JP H 6-167873 A 6/1994

* cited by examiner

*Primary Examiner* — Robert Beatty
(74) *Attorney, Agent, or Firm* — Stein IP, LLC

(57) ABSTRACT

An image forming apparatus has an image carrier, a charger, a developing device, a voltage application unit, and a controller. The developing device includes a developing roller. The voltage application unit applies a voltage to the developing roller and to the charger. The controller controls the voltage application unit. The controller controls the voltage application unit such that a developing bias having an AC voltage superposed on a DC voltage is applied to the developing roller and a charging bias including at least a DC voltage and having superposed thereon a compensation AC voltage with an opposite phase to an AC voltage induced in the charger by the developing bias is applied to the charger.

3 Claims, 2 Drawing Sheets

IMAGE FORMING APPARATUS HAVING A VOLTAGE APPLICATION UNIT FOR APPLYING A VOLTAGE TO A DEVELOPING ROLLER AND A CHARGER

INCORPORATION BY REFERENCE

This application is based upon and claims the benefit of priority from the corresponding Japanese Patent Application No. 2015-096274 filed on May 11, 2015, the entire contents of which are incorporated herein by reference.

BACKGROUND

The present invention relates to an image forming apparatus, and more particularly to an image forming apparatus provided with a charger for electrostatically charging an image carrier.

There are conventionally known image forming apparatuses that are provided with a charging roller (charger) for electrostatically charging a photosensitive drum (image carrier), a developing device including a developing roller for supplying the photosensitive drum with toner, and a voltage application unit for applying a voltage to the charging roller and to the developing roller. A developing bias having an AC voltage superposed on a DC voltage is applied to the developing roller, and a charging bias including a DC voltage is applied to the charging roller.

There are also known image forming apparatuses in which an electric shield formed by an electrically conductive member is arranged between a charging roller and a developing sleeve (developing roller). In such image forming apparatuses, an AC component in a developing bias applied to the developing sleeve can be prevented from adversely affecting the charging roller. It is thus possible to suppress uneven charging of the photosensitive drum.

SUMMARY

According to one aspect of the present disclosure, an image forming apparatus includes an image carrier, a charger, a developing device, a voltage application unit, and a controller. On the image carrier, an electrostatic latent image is formed. The charger electrostatically charges the image carrier. The developing device includes a developing roller that is arranged opposite the image carrier and that supplies toner to the image carrier. The developing device stores developer containing toner and carrier. The voltage application unit applies a voltage to the developing roller and to the charger. The controller controls the voltage application unit. The controller controls the voltage application unit such that a developing bias having an AC voltage superposed on a DC voltage is applied to the developing roller and a charging bias including at least a DC voltage and having superposed thereon a compensation AC voltage with the opposite phase to an AC voltage induced in the charger by the developing bias is applied to the charger.

Other objects of, and specific benefits resulting from, the present disclosure will become clear with reference to the following description of embodiments thereof.

DETAILED DESCRIPTION

An embodiment of the present disclosure will be described below with reference to the accompanying drawings.

Figure 1:
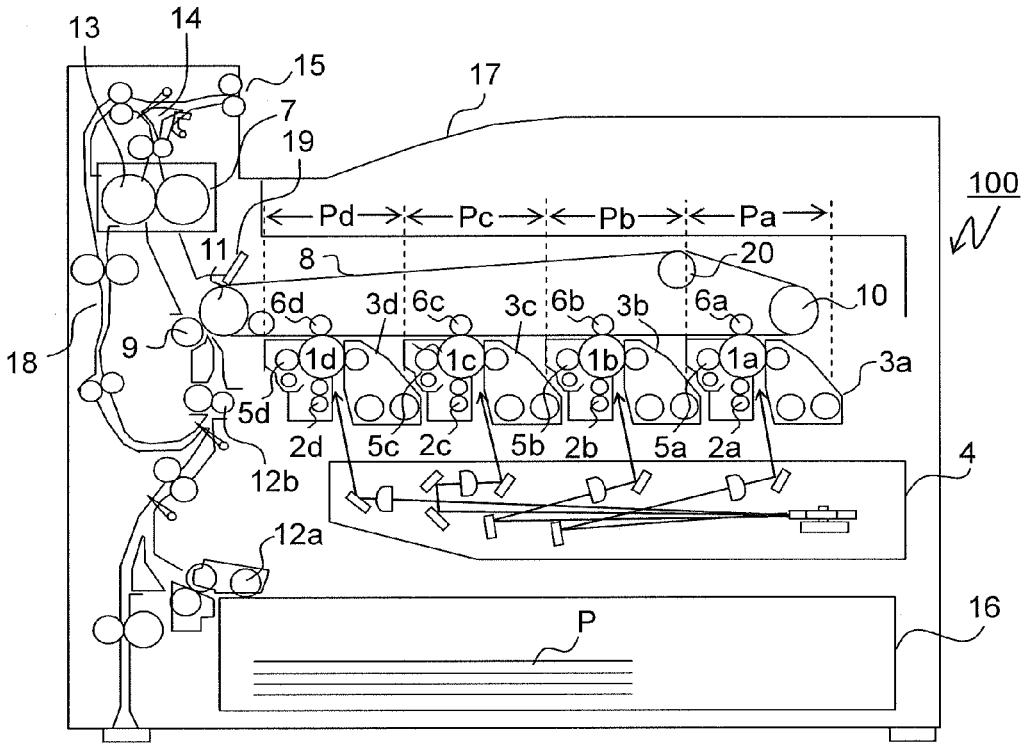
FIG. 1 is a sectional view schematically showing a structure of an image forming apparatus according to one embodiment of the present disclosure.
Figure 2:
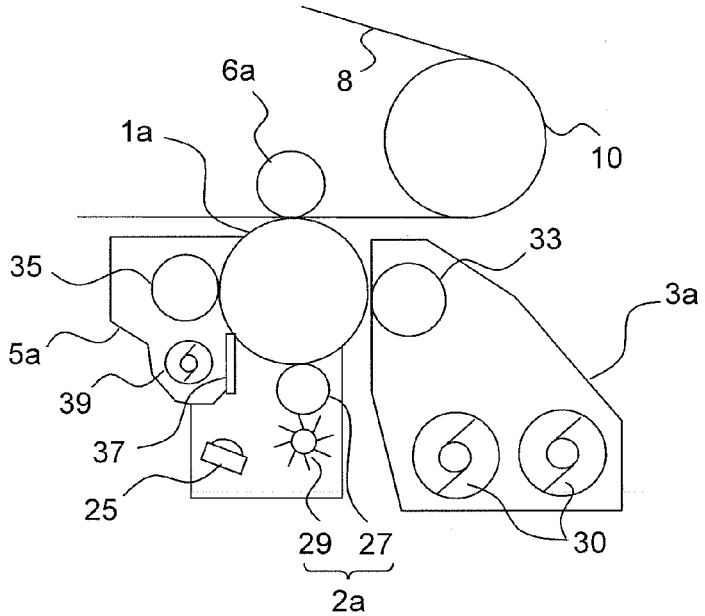
FIG. 2 is a sectional view showing a structure of and around an image forming unit Pa in FIG. 1.
Figure 3:
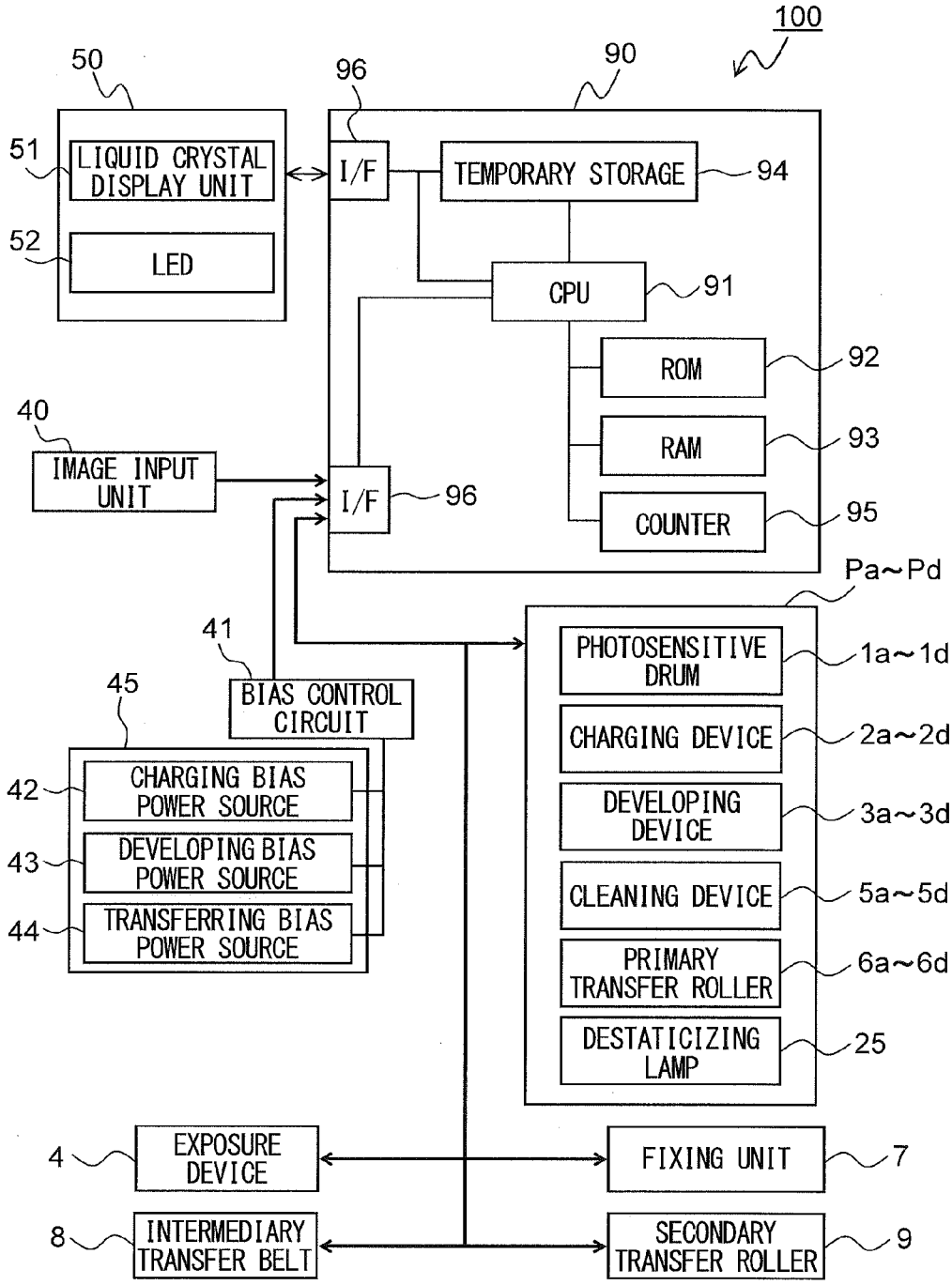
FIG. 3 is a block diagram showing control pathways in an image forming apparatus according to one embodiment of the present disclosure.

With reference to FIGS. 1 to 3, an image forming apparatus 100 according to one embodiment of the present disclosure will be described. Inside a body of the image forming apparatus (here, a tandem-type color printer) 100, there are arranged four image forming units Pa, Pb, Pc, and Pd in this order from the upstream side (in FIG. 1, the right side) with respect to the transport direction. These image forming units Pa to Pd are provided to correspond to four different colors (magenta, cyan, yellow, and black), and sequentially form a magenta, a cyan, a yellow, and a black image each through the processes of electrostatic charging, exposure to light, image development, and image transfer.

In the image forming units Pa to Pd, there are respectively arranged photosensitive drums (image carriers) 1*a*, 1*b*, 1*c*, and 1*d* for carrying visible images (toner images) of the different colors. Next to the image forming units Pa to Pd, there is arranged an intermediary transfer belt 8 which rotates clockwise in FIG. 1 by being driven by a driving means (unillustrated). Toner images formed on the photosensitive drums 1*a* to 1*d* are sequentially transferred to the intermediary transfer belt 8, which moves while being in contact with the photosensitive drums 1*a* to 1*d*. The toner images are then simultaneously transferred to a sheet P by a secondary transfer roller 9, and are then fixed to the sheet P in a fixing unit 7. The sheet P is then discharged out of the apparatus body. While the photosensitive drums 1*a* to 1*d* are rotated counter-clockwise in FIG. 1, the image forming processes are performed with respect to each of the photosensitive drums 1*a* to 1*d*.

Sheets P to which toner images are to be transferred are stored in a sheet cassette 16 provided in a lower part of the apparatus, and are transported via a sheet feed roller 12*a* and a registration roller pair 12*b* to the secondary transfer roller 9. Used as the intermediary transfer belt 8 is a sheet of a dielectric resin, and it typically is a belt with no seam (seamless belt). On the downstream side of the secondary transfer roller 9, there is arranged a blade-form belt cleaner 19 for removing toner that is left behind on the surface of the intermediary transfer belt 8.

Next, the image forming units Pa to Pd will be described. The surfaces of the photosensitive drums 1*a* to 1*d*, which are rotatably arranged, are formed of a single layer of an organic photosensitive substance (OPC). Around and under the photosensitive drums 1*a* to 1*d*, there are arranged charging devices 2*a*, 2*b*, 2*c*, and 2*d* for electrostatically charging the photosensitive drums 1*a* to 1*d*; an exposure device 4 for exposing the photosensitive drums 1*a* to 1*d* to light conveying image information; developing devices 3*a*, 3*b*, 3*c*, and 3*d* for forming toner images on the photosensitive drums 1*a* to 1*d*; and cleaning devices 5*a*, 5*b*, 5*c*, and 5*d* for removing developer (toner) that is left behind on the photosensitive drums 1*a* to 1*d*.

When a user enters an instruction to start image formation, first, the charging devices 2*a* to 2*d* electrostatically charge the surfaces of the photosensitive drums 1*a* to 1*d* uniformly. Next, the exposure device 4 irradiates the photosensitive drums 1*a* to 1*d* with light, thereby to form electrostatic latent images based on an image signal on them. The developing devices 3*a* to 3*d* include developing rollers 33 (see FIG. 2) arranged opposite the photosensitive drums 1*a* to 1*d*, and are charged with predetermined amounts of toner of different colors, namely magenta, cyan, yellow, and black respectively, by toner supplying devices (unillustrated). The toner is fed from the developing rollers 33 of the developing devices 3*a* to 3*d* onto the photosensitive drums 1*a* to 1*d*, and electrostatically attaches to them, thereby forming toner images based on the electrostatic latent images formed by exposure to light from the exposure device 4.

With an electric field applied to the intermediary transfer belt 8 with a predetermined transfer voltage, the primary transfer rollers 6*a* to 6*d* primarily transfer the magenta, cyan, yellow, and black toner images on the photosensitive drums 1*a* to 1*d* to the intermediary transfer belt 8. These images of four colors are formed in a predetermined positional relationship that is prescribed for the formation of a predetermined full-color image. Thereafter, in preparation to the subsequent formation of new electrostatic latent images, toner that has been left behind on the surfaces of the photosensitive drums 1*a* to 1*d* is removed by the cleaning devices 5*a* to 5*b*.

The intermediary transfer belt 8 is wound around a plurality of suspension rollers including a driven roller 10, a driving roller 11, and a tension roller 20. As the driving roller 11 rotates by being driven by a driving motor (unillustrated), the intermediary transfer belt 8 rotates clockwise. As a result, a sheet P is transported from the registration roller pair 12*b*, with a predetermined timing, to the secondary transfer roller 9, which is arranged next to the intermediary transfer belt 8. At the nip between the secondary transfer roller 9 and the intermediary transfer belt 8 (the secondary nip), a full-color image is secondarily transferred to the sheet P. The sheet P having the toner images transferred to it is then transported to the fixing unit 7.

The sheet P transported to the fixing unit 7 passes through the nip (the fixing nip) between a fixing roller pair 13, and is meanwhile heated and pressed, so that the toner images are fixed to the surface of the sheet P, thereby forming the predetermined full-color image. The sheet P having the full-color image formed on it is sorted between different transport directions by a branch unit 14 which branches into a plurality of directions. When only one side of the sheet P is subjected to image formation, it is discharged directly onto a discharge tray 17 by a discharge roller pair 15.

On the other hand, when both sides of the sheet P are subjected to image formation, part of the sheet P having passed through the fixing unit 7 is stuck out of the apparatus via the discharge roller pair 15 momentarily. Subsequently, the discharge roller pair 15 is rotated in the reverse direction, and the sheet P is sorted by the branch unit into a sheet transport passage 18, so that the sheet P is transported once again, with the image side reversed this time, to the registration roller pair 12*b*. Then, the next images formed on the intermediary transfer belt 8 are transferred by the secondary transfer roller 9 to the side of the sheet P on which no image has been formed yet. The sheet P is then transported to the fixing unit 7, where the toner images are fixed, and is then discharged onto the discharge tray 17.

Next, with reference to FIG. 2, the structure of the image forming unit Pa will be described in detail. The following description focuses on the image forming unit Pa shown in FIG. 1; since the image forming units Pb to Pd have basically the same structure, no overlapping description will be repeated.

Around the photosensitive drum 1*a*, there are arranged, along the drum rotation direction (in FIG. 2, the counterclockwise direction), a charging device 2*a*, a developing device 3*a*, a cleaning device 5*a*, and a destaticizing lamp 25. Between the developing device 3*a* and the cleaning device 5*a*, across the intermediary transfer belt 8, the primary transfer roller 6 is arranged.

The charging device 2*a* includes a charging roller (charger) 27, which makes contact with the photosensitive drum 1*a* to electrically charge the drum surface uniformly, and a charging cleaning brush 29, which cleans the charging roller 27. Instead of the charging cleaning brush 29, a charging cleaning roller may be used. To the charging roller 27, a predetermined DC (direct-current) bias and a predetermined AC (alternating-current) bias are applied by a charging bias power source 42 (see FIG. 3).

The developing device 3*a* includes two stir-transport screws 30 and a developing roller 33, and stores two-component developer (hereinafter referred to simply as developer) in which non-magnetic toner is electrostatically charged by use of magnetic carrier. The developing device 3*a* forms a magnetic brush composed of magnetic carrier and toner on the developing roller 33. When a developing bias is applied to the developing roller 33, toner flies to the photosensitive drum 1*a*.

The cleaning device 5*a* includes a friction roller 35, a cleaning blade 37, and a collecting screw 39. The friction roller 35 is kept in pressed contact with the photosensitive drum 1*a* under a predetermined pressure, and is driven to rotate by an unillustrated driving means in the same direction as observed at the face of contact with the photosensitive drum 1*a*. The cleaning blade 37 is fixed so as to remain in contact with the surface of the photosensitive drum 1*a*, on the downstream side of the face of contact with the friction roller 35 with respect to the rotation direction. The residual toner removed from the surface of the photosensitive drum 1*a* by the friction roller 35 and the cleaning blade 37 is discharged out of the cleaning device 5*a* as the collecting screw 39 rotates.

Between the cleaning device 5*a* and the charging device 2*a*, the destaticizing lamp 25 is arranged. The destaticizing lamp 25 irradiates the surface of the photosensitive drum 1*a* with light, and thereby removes residual electric charge from the drum surface.

Next, with reference to FIG. 3, control pathways in the image forming apparatus 100 according to the present disclosure will be described. When the image forming apparatus 100 is used, different parts of it are controlled in different manners, and thus the entire image forming apparatus 100 has complicated control pathways. The following description focuses on, of all those control pathways, those which are essential for the implementation of the present disclosure.

In a case where the image forming apparatus 100 is a printer like the one shown in FIG. 1, an image input unit 40 is a receiver unit that receives image data transmitted from a personal computer or the like. In a case where the image forming apparatus 100 is a copier, the image forming apparatus 100 is an image reading unit that includes a scanning optical system incorporating a scanner lamp for illuminating a document during copying and a mirror for changing the optical path of reflected light from the document, a condenser lens for converging and focusing the reflected light from the document, and a CCD or the like for converting the focused image light into an electric signal. An image signal fed in via the image input unit 40 is converted into a digital signal and is then fed to a temporary storage 94.

A bias control circuit 41 is connected to a charging bias power source 42, a developing bias power source 43, and a transferring bias power source 44, which are all provided in a bias power source unit (voltage application unit) 45, and operates those power sources according to an output signal from a controller 90. According to a control signal from the bias control circuit 41, those power sources apply predetermined biases to the charging roller 27, the developing roller 33, the primary transfer rollers 6*a* to 6*d*, and the secondary transfer roller 9.

An operation unit 50 includes a liquid crystal display unit 51, and includes LEDs 52 for indicating various states. By operating the operation unit 50 and thereby entering instructions, a user can make various settings on, and execute various functions, such as image formation, of, the image forming apparatus 100. The liquid crystal display unit 51 can display the status of the image forming apparatus 100, the progress of image formation, and the number of copies printed, and also permits, as a touch panel, selection of functions, such as two-side printing and black-white reversal, and various settings on magnification, density, etc.

The operation unit 50 further includes a Start button, which the user can operate to start image formation; a Stop/Clear button, which the user can operate to stop image formation; a Reset button, which the user can operate to restore the initial settings of the image forming apparatus 100; etc.

The controller 90 at least includes a CPU 91 as a central processing unit, ROM (read-only memory) 92 dedicated to reading of data from it, RAM (random-access memory) 93 that allows both writing of data to and reading of data from it, a temporary storage 94 for temporary storage of image data or the like, a counter 95, and a plurality of (here, two) interfaces (I/Fs) 96 for transmission of control signals to different devices within the image forming apparatus 100 and for reception of input signals from the operation unit 50. The controller 90 can be arranged wherever appropriate inside the apparatus body.

In the ROM 92 are stored programs for controlling the image forming apparatus 100 and data and the like that are not changed while the image forming apparatus 100 is used, such as values needed for its control. In the RAM 93 are stored data generated in the course of controlling the image forming apparatus 100, data temporarily needed for its control, etc. The counter 95 counts the cumulative number of sheets printed. The counter 95 does not have to be provided separately; instead, the number of sheets may be stored, for example, in the RAM 93.

The controller 90 also transmits control signals from the CPU 91 via the interfaces 96 to different parts and devices within the image forming apparatus 100. From those different parts and devices, signals indicating their status and input signals are transmitted via the interfaces 96 to the CPU 91. The parts and devices that are controlled by the controller 90 include, for example, the image forming units Pa to Pd, the exposure device 4, the fixing unit 7, the intermediary transfer belt 8, the secondary transfer roller 9, the image input unit 40, the bias control circuit 41, the operation unit 50, etc.

Furthermore, the controller 90 controls the developing bias power source 43 in the bias power source unit 45 via the bias control circuit 41 to apply a developing bias having an AC voltage superposed on a DC voltage to the developing roller 33. When the developing bias is applied to the developing roller 33, the AC component in the developing bias induces an AC voltage in the charging roller 27. This induced voltage depends on the amplitude of the AC component in the developing bias, the distance between the developing roller 33 and the charging roller 27, etc., and thus can be predicted.

The controller 90 controls the charging bias power source 42 in the bias power source unit 45 via the bias control circuit 41 to apply, as a charging bias, a DC voltage having superposed on it a compensation AC voltage that has the opposite phase to the AC voltage induced in the charging roller 27 to the charging roller 27.

It is preferable that the compensation AC voltage have an amplitude that is 25% or more but 200% or less of the amplitude of the induced voltage, and more preferably 50% or more but 150% or less of the amplitude of the induced voltage.

In the embodiment, as described above, the charging bias applied to the charging roller 27 has superposed on it a compensation AC voltage having the opposite phase to the voltage induced in the charging roller 27 by the developing bias. Thus, the induced voltage and the compensation AC voltage cancel each other. This helps suppress uneven charging of the photosensitive drums 1*a* to 1*d*, and thus helps suppress image disturbance.

Thus, in the embodiment, there is no need to provide an electric shield between the charging roller 27 and the developing roller 33. This helps suppress an increase in the number of components, and helps suppress an increase in the size and weight of the apparatus.

Moreover, as described above, it is preferable that the compensation AC voltage have an amplitude that is 25% or more but 200% or less of the amplitude of the induced voltage. With this configuration, the induced voltage and the compensation AC voltage cancel each other effectively. This helps more effectively suppress uneven charging of the photosensitive drums 1*a* to 1*d*, and thus helps more effectively suppress image disturbance.

Moreover, as described above, it is preferable that the compensation AC voltage have an amplitude that is 50% or more but 150% or less of the amplitude of the induced voltage. With this configuration, the induced voltage and the compensation AC voltage cancel each other more effectively. This helps sufficiently suppress uneven charging of the photosensitive drums 1*a* to 1*d*, and thus helps sufficiently suppress image disturbance.

Moreover, as described above, in a structure where the surfaces of the photosensitive drums 1*a* to 1*d* are formed of a single layer of an organic photosensitive substance (OPC), the photosensitive drums 1*a* to 1*d* tend to suffer from uneven charging, and thus it is especially effective to apply the present disclosure.

To confirm the effect of the embodiment described above, tests were performed, which will now be described. The tests were performed with Practical Examples 1 to 5, which correspond to the embodiment described above, and Comparative Examples 1 and 2.

Practical Example 1

In Practical Example 1, to the developing roller 33 was applied a developing bias having a rectangular-waveform AC voltage Vdev(AC) with a peak-to-peak voltage (Vpp) of 1000 V superposed on a DC voltage Vdev(DC) of 350 V. The AC voltage Vdev(AC) had a frequency of 4.0 kHz and a duty factor of 50%. When this developing bias was applied to the developing roller 33, the AC component Vdev(AC) in the developing bias induced an AC voltage Vevo(AC) of 200 V in the charging roller 27. Moreover, in Practical Example 1, to the charging roller 27 was applied, as a charging bias, a DC voltage Vch(DC) of 1200 V having superposed on it a compensation AC voltage Vch(AC) with a Vpp of 50 V and with the opposite phase to the induced voltage (with a phase difference of 180°). That is, in Practical Example 1, the compensation AC voltage Vch(AC) had an amplitude that was 25% of the amplitude of the induced voltage Vevo(AC). The compensation AC voltage Vch(AC) had a frequency of 4.0 kHz and a duty ratio of 50%. In other respects, Practical Example 1 was configured similarly as in the embodiment described previously.

Practical Example 2

In Practical Example 2, the compensation AC voltage Vch(AC) was 100 V. That is, in Practical Example 2, the compensation AC voltage Vch(AC) had an amplitude that was 50% of the amplitude of the induced voltage Vevo(AC). The other conditions were the same as in Practical Example 1.

Practical Example 3

In Practical Example 3, the compensation AC voltage Vch(AC) was 200 V. That is, in Practical Example 3, the compensation AC voltage Vch(AC) had an amplitude that was 100% of the amplitude of the induced voltage Vevo (AC). The other conditions were the same as in Practical Example 1.

Practical Example 4

In Practical Example 4, the compensation AC voltage Vch(AC) was 300 V. That is, in Practical Example 4, the compensation AC voltage Vch(AC) had an amplitude that was 150% of the amplitude of the induced voltage Vevo (AC). The other conditions were the same as in Practical Example 1.

Practical Example 5

In Practical Example 5, the compensation AC voltage Vch(AC) was 400 V. That is, in Practical Example 4, the compensation AC voltage Vch(AC) had an amplitude that was 200% of the amplitude of the induced voltage Vevo (AC). The other conditions were the same as in Practical Example 1.

Comparative Example 1

In Comparative Example 1, to the charging roller 27 was applied, as a charging bias, only a DC voltage Vch(DC) of 1200 V. That is, in Comparative Example 1, no compensation AC voltage Vch(AC) was applied. The other conditions were the same as in Practical Example 1.

Comparative Example 2

In Comparative Example 2, to the charging roller 27 was applied, as a charging bias, a DC voltage Vch(DC) of 1200 V having superposed on it a compensation AC voltage Vch(AC) with a Vpp of 100 V and with the same phase (with a phase difference of 0°) as the induced voltage. The other conditions were the same as in Practical Example 1.

The tested machine had the following conditions. The process speed (printing speed) was 26 sheets per minute. The circumferential velocity of the photosensitive drums 1*a* to 1*d* was 165 mm per second. The photosensitive drums 1*a* to 1*d* had a diameter of 24 mm. The circumferential velocity of the developing roller 33 was 1.6 times that of the photosensitive drums 1*a* to 1*d* (forward rotation at the opposing face), namely about 264 mm per second. The gap between the developing roller 33 and the photosensitive drums 1*a* to 1*d* was 0.40 mm. The surfaces of the photosensitive drums 1*a* to 1*d* were formed of a single layer of an organic photosensitive substance (OPC) by a dipping method. As developer, two-component developer was used which contained positively charged toner with an average particle diameter of 6.8 μm mixed with magnetic carrier.

With each of Practical Examples 1 to 5 and Comparative Examples 1 and 2, an image with a solid pattern was printed, and disturbance in the image was inspected visually. The results are shown in Table 1. "Poor" indicates practically unacceptable image disturbance, "Fair" indicates recognizable but practically acceptable image disturbance, and "Good" indicates hardly recognizable image disturbance.

TABLE 1

| | Voltage Applied To Developing Roller | | | Induced Voltage | | Voltage Applied To Charging Roller | | | |
|---|---|---|---|---|---|---|---|---|---|
| | Vdev(DC) [V] | Vdev(AC) [V] | Phase Difference [Degrees] | Vevo(AC) [V] | Phase Difference [Degrees] | Vch(DC) [V] | Vch(AC) [V] | Phase Difference [Degrees] | Image Disturbance |
| Comparative Example 1 | 350 | 1000 | 0 | 200 | 0 | 1200 | 0 | — | Poor |
| Practical Example 1 | 350 | 1000 | 0 | 200 | 0 | 1200 | 50 | 180 | Fair |
| Practical Example 2 | 350 | 1000 | 0 | 200 | 0 | 1200 | 100 | 180 | Good |
| Practical Example 3 | 350 | 1000 | 0 | 200 | 0 | 1200 | 200 | 180 | Good |
| Practical Example 4 | 350 | 1000 | 0 | 200 | 0 | 1200 | 300 | 180 | Good |
| Practical Example 5 | 350 | 1000 | 0 | 200 | 0 | 1200 | 400 | 180 | Fair |
| Comparative Example 2 | 350 | 1000 | 0 | 200 | 0 | 1200 | 100 | 0 | Good (Low Density) |

Table 1 reveals the following. In Comparative Example 1, practically unacceptable image disturbance occurred. It is considered that the induced voltage Vevo(AC) that occurred in the charging roller 27 caused uneven discharging of the photosensitive drums 1*a* to 1*d*, resulting in image disturbance.

The image disturbance occurred only in one end part of the image in the sheet width direction (the axial direction of the photosensitive drums 1*a* to 1*d*). The reason is considered to be as follows. When the surfaces of the photosensitive drums 1*a* to 1*d* are formed of a single layer of an organic photosensitive substance (OPC) by a dipping method, the thickness of the organic photosensitive substance layer varies slightly in the axial direction of the photosensitive drums 1*a* to 1*d*. In one end part of the photosensitive drums 1*a* to 1*d* where the thickness of the organic photosensitive substance layer is smaller, uneven charging causes image disturbance. Thus, it is considered that when the surfaces of the photosensitive drums 1*a* to 1*d* are formed of a single layer of an organic photosensitive substance (OPC), image disturbance tends to occur.

In Practical Example 1, image disturbance was suppressed. The reason is considered to be as follows. As a result of a compensation AC voltage Vch(AC) of 50 V with the opposite phase (with a phase difference of 180°) to the induced voltage being applied to the charging roller 27, the induced voltage and the compensation AC voltage canceled each other; this suppressed uneven charging of the photosensitive drums 1*a* to 1*d*, and thus suppressed image disturbance.

In Practical Examples 2 to 4, image disturbance was suppressed sufficiently. The reason is considered to be as follows. As a result of a compensation AC voltage Vch(AC) of 100 V, 200 V, or 300 V with the opposite phase (with a phase difference of 180°) to the induced voltage being applied to the charging roller 27, the induced voltage and the compensation AC voltage canceled each other sufficiently; this suppressed uneven charging of the photosensitive drums 1*a* to 1*d* sufficiently, and thus suppressed image disturbance sufficiently.

In Practical Example 5, image disturbance was suppressed. The reason is considered to be as follows. As a result of a compensation AC voltage Vch(AC) of 400 V with the opposite phase (with a phase difference of 180°) to the induced voltage being applied to the charging roller 27, the induced voltage and the compensation AC voltage canceled each other; this suppressed uneven charging of the photosensitive drums 1*a* to 1*d*, and thus suppressed image disturbance. In Practical Example 5, although applying a compensation AC voltage Vch(AC) of 400 V to the charging roller 27 leaves an AC component of 200 V, the results were different from those obtained in Comparative Example 1. The reason is considered to be as follows. The induced voltage occurring in the charging roller 27 did not have a definite waveform, such as a rectangular or sinusoid waveform, but had a disturbed waveform. On the other hand, a compensation AC voltage with a rectangular waveform was applied, in a superposed fashion, to the charging roller 27. Thus, the waveform after mutual cancellation differed in Comparative Example 1 and in Practical Example 5. This is considered to have resulted in a different degree of image disturbance in Practical Example 5 than in Comparative Example 1.

In Comparative Example 2, no image disturbance was observed, but the entire image had undesirably low density. The reason that no image disturbance was observed in Comparative Example 2 is considered to be as follows. In Comparative Example 2, applying a compensation AC voltage of 100 V with the same phase (with a phase difference of 0°) as the induced voltage to the charging roller 27 resulted in so uneven charging that no image disturbance could be recognized visually.

It is to be understood that the embodiments disclosed herein are in every aspect only illustrative and not restrictive. The scope of the present disclosure is defined not by the description of embodiments given above but by the appended claims, and encompasses any modification made in the sense and scope equivalent to those of the appended claims.

Although the embodiment deals with a case where the present disclosure is applied to a color printer, this is not meant to be any limitation. Needless to say, the present disclosure is applicable to various image forming apparatuses provided with a charger for electrostatically charging an image carrier, such as monochrome printers, monochrome copiers, digital multifunction peripherals, facsimile machines. etc.

Between the stir-transport screws 30 and the developing roller 33, there may be provided a magnetic roller for forming on the surface a magnetic brush composed of magnetic carrier and toner and for supplying the developing roller 33 with toner.

Although the embodiment described above deals with an example where the charging bias is a DC voltage, this is not meant to be any limitation; the charging bias may have an AC voltage superposed on a DC voltage. In that case, let the AC voltage in the charging bias be Vch2(AC) (with a phase difference of 0°), then it is considered that, if −200 V≤Vch2(AC)+Vevo(AC)−Vch(AC) 150 V is fulfilled, image disturbance will be practically acceptable and, if −100 V≤Vch2(AC)+Vevo(AC)−Vch(AC) 100 V, image disturbance will be hardly recognizable.

What is claimed is:

1. An image forming apparatus, comprising:

an image carrier on which an electrostatic latent image is formed;

a charger that electrostatically charges the image carrier;

a developing device including a developing roller that is arranged opposite the image carrier and that supplies toner to the image carrier, the developing device storing developer containing toner and carrier;

a voltage application unit that applies a voltage to the developing roller and to the charger; and a controller that controls the voltage application unit, wherein the controller controls the voltage application unit such that a developing bias having an AC voltage superposed on a DC voltage is applied to the developing roller and a charging bias including at least a DC voltage and having superposed thereon a compensation AC voltage with an opposite phase to an AC voltage induced in the charger by the developing bias is applied to the charger, and the compensation AC voltage has an amplitude that is 25% or more but 200% or less of an amplitude of the induced voltage.

2. The image forming apparatus of claim 1, wherein the compensation AC voltage has an amplitude that is 50% or more but 150% or less of an amplitude of the induced voltage.

3. The image forming apparatus of claim 1, wherein a surface of the image carrier is formed of a single layer of an organic photosensitive substance.

* * * * *